United States Patent [19]

Klein et al.

[11] 4,209,326

[45] Jun. 24, 1980

[54] METHOD FOR PRODUCING METAL POWDER HAVING RAPID SINTERING CHARACTERISTICS

[75] Inventors: Albert J. Klein, Arlington Heights, Ill.; William H. Hooper, Fairfield, Conn.

[73] Assignee: American Can Company, Greenwich, Conn.

[21] Appl. No.: 916,852

[22] Filed: Jun. 19, 1978

Related U.S. Application Data

[63] Continuation-in-part of Ser. No. 810,479, Jun. 27, 1977, abandoned.

[51] Int. Cl.[2] ..... B22F 3/00; B22F 1/00

[52] U.S. Cl. ..... 75/211; 75/0.5 R

[58] Field of Search ..... 75/0.5 BA, 0.5 BC, 211, 75/206

[56] References Cited

U.S. PATENT DOCUMENTS

| | | | |
|---|---|---|---|
| 3,764,295 | 10/1973 | Lindskog et al. | 75/0.5 C |
| 3,865,575 | 2/1975 | Volin et al. | 75/0.5 BA |
| 3,976,482 | 8/1976 | Larson | 75/211 |
| 4,069,045 | 1/1978 | Lundgren | 75/0.5 C |

*Primary Examiner*—Brooks H. Hunt

*Attorney, Agent, or Firm*—Robert P. Auber; Ira S. Dorman; Stuart S. Bowie

[57] ABSTRACT

A process for modifying or removing the prior powder particle boundaries and surface films from ferrous particulate metals and alloys, such as iron, low carbon steel and low alloy steel, for burnishing the clean, freshly revealed metal surfaces of the particles, and for inducing and storing energy of deformation into the surface layers of said particles. The sintering characteristics of metal powders are improved, and the most rapid sintering characteristics are produced.

For example, in as-water-atomized ferrous metal particles, the surface film or skin is mostly oxides of iron and mixed oxides of the constituents of iron alloys. The skin is removed in a high velocity, turbulent whirling gas stream, which impacts the particles into each other, and the resulting burnished iron and steel cores are collected, together with the finely shattered oxide skins. The cores are then preferably magnetically separated from the non-ferrous material, and the finely shattered skin is separated from the coarser iron and steel cores. The bright metal cores may then be made into low oxide powder metallurgy objects as well as sheet and strip of low oxide steel. The bright metal highly energized and physically strained surfaces of the iron and steel cores promote very rapid sintering of the cores.

5 Claims, 3 Drawing Figures

METHOD FOR PRODUCING METAL POWDER HAVING RAPID SINTERING CHARACTERISTICS

BACKGROUND OF THE INVENTION

This is a continuation-in-part of U.S. patent application Ser. No. 810,479, filed June 27, 1977 for "METHOD FOR PRODUCING METAL POWDER HAVING RAPID SINTERING CHARACTERISTICS," now abandoned.

Rapid sintering of metal powders is an ideal which has long been sought in the powder metallurgy art. It is important to speed in production lines and to reduce costs. Another desire of powder metallurgy parts producers is to manufacture parts for high performance application which require stronger particle-to-particle bonds and fewer inter-metallic inclusions than are obtainable with presently available commercial particles.

Typically, powder metallurgy particles are produced with a minimum of surface oxides. If oxides occur, they may be removed, for example, by placing the particles in a reducing atmosphere or an acid bath. Such removal, while allowing good quality parts to be made, still requires substantial sintering times which vary from thirty minutes upward.

Thirty minutes, for example, is a typical minimum time for sintering of the best prepared as-water-atomized ferrous metal particles where the surface oxides have been removed by chemical reduction.

As-water-atomized ferrous metal particles are particles produced by intercepting a downwardly moving stream of molten steel by jets of water. The stream is broken and the resulting metallic particles drop into a pool of water where they are further cooled. The core material of the particles is mostly martensite covered with a skin of mostly iron oxides with some mixed oxides of the constituents of iron alloys such as, for example, manganese, chromium and aluminum oxides and a small residue of other materials such as silica. The produced as-water-atomized ferrous metal particles are then subjected to the process of this invention.

When as-water-atomized ferrous metal particles are made, oxides are produced by the cooling water on the skin of the particles. Some oxides are easily reducible by heating in a reducing atmosphere.

Other ferrous oxides and mixed oxides of the constituents of ferrous alloys as well as other impurities such as silica in the skin are suspended in the melt from which the particles are made. The mixed oxides, particularly the non-ferrous oxides, historically are difficult to reduce by normal reduction annealing. The mixed oxides and other impurities appear along with molten steel in the molten stream from which particles are made. The steel melting temperature is substantially higher than the melting temperatures of the oxides and other impurities so that as the particles solidify the steel solidifies before the oxides and impurities solidify. Although some of the oxides are trapped in the ferrous metal cores, most of the oxides, which are sticky when hot, adhere to the outside of the ferrous metal cores and harden to form a brittle skin at ambient temperature.

In the production of as-water-atomized ferrous metal particles, they may be subjected to a reduction anneal in a reducing atmosphere but, while this treatment reduces iron oxides to metallic iron, the other constituent oxides of ferrous alloys remain substantially unaffected, and these constitute diffusion barriers and give rise to non-metallic inclusions in powder metal products. It is a prime objective of the present invention to remove the iron oxides, oxides of alloy constituents, and other impurities from the surfaces of ferrous powder particles such as iron, low carbon steel and low alloy steel, and particularly removing such oxides and impurities from as-water-atomized particles.

The following United States patents are believed to represent the prior art.

U.S. Pat. No. 3,764,295 which issued Oct. 9, 1973, to P. F. Lindskog, et. al. for a "Method of Manufacturing Low-Alloy Steel Powder Having a Low Content of Oxidic Constituents" pertains to a technique for producing as-water-atomized ferrous metal particles. To remove oxide coatings from the particles, in one embodiment of the patented invention, the powder is "subjected to mechanical treatment" to crack the oxide skins, thereby making it easy for acid to penetrate. The particles are then dipped in an acid bath to loosen the oxide coatings. After the oxide coatings are loosened by the acid, the particles are again subjected to "mechanical treatment" to remove the residue of oxides. No disclosure is made of the type of mechanical treatment used although a "disintegrator" is mentioned.

U.S. Pat. No. 4,069,045 which issued Jan. 17, 1978 to B. G. S. Lundgren for a "Metal Powder Suited for Powder Metallurgical Purposes, and a Process for Manufacturing the Metal Powder" pertains to a technique for producing powder flakes which are then ground up. Molten steel is dropped onto the flat face of a highly conductive plate which forms the steel into a flake. The conductive plate is spun to throw off the cooled flakes by centrifugal action to make room for subsequent deposits of steel. The flakes are stopped by the walls of the enclosure surrounding the turn table, and they fall downward and out of the enclosoure. The formed flakes themselves are brittle, so they easily can be crushed or ground. The metal flake is formed either under a vacuum or in a protective gaseous atmosphere to avoid producing oxide films or skin on the flake. The flake is then crushed or ground into a powder. The resultant powder is very hard, and it has no oxide skin.

U.S. Pat. No. 3,865,575 issued Feb. 11, 1975 to T. E. Volin, et. al. for a "Thermoplastic Prealloyed Powder" pertains to the production of super plasticity in certain particles, particularly nickel alloys. To produce the super plasticity the particles are subjected to continuous and repeated impacts which compressively deform the particles and knead them until substantial saturation hardness is reached. The required compressive forces may be applied by Spex mills, attritor mills, vibratory mills or planetary ball mills pounding and deforming the powder for from one to ten hours. The resulting super-plastic powder is substantially amorphous, with its crystal structure destroyed, and it may be compacted to form useful objects. After compaction, typically a new crystalline structure may be regrown to harden and strengthen the finished object.

U.S. Pat. No. 3,976,482 issued Aug. 24, 1976 to J. M. Larson for a "Method of Making Prealloyed Thermoplastic Powder and Consolidated Article" pertains to flattening particles into discs by pouring them into the nip of a pair of rollers. This patent, too, is directed to a means for producing a super-plastic powder by deformation, such as through repeated roll passes.

While some of the above-mentioned patents address (a) the desirability of removing oxide films from the surface of powder particles and (b) the usefulness and means of achieving the physical state of certain highly alloyed metals known as super plasticity, none of the patents specifically addresses the desirability of achieving extremely rapid sintering rates between particles of iron, low carbon steel and low alloy steel.

BRIEF DESCRIPTION OF THE INVENTION

The careful following of the process described and claimed herein mechanically disrupts and knocks and off the brittle oxide skin on the surface of each particle, then grinds the fragmented oxide skins into a fine powder without significantly affecting the size of the freshly exposed metal cores which are then burnished to form a flowed layer of clean metal, wherein the burnished surface layers are mechanically deformed by repeated inter-particle impacts and wherein strain energy is imparted into these surfaces layers leaving the remainder of the central core relatively unaffected. The rounding of the burnished cores materially improves their flow characteristics.

To improve the sinterability of ferrous metal particles, they may be conditioned by cracking and shattering the mostly oxide skin of the particles by confining them in a whirling high velocity gas stream to cause them to strike each other. The cracked skins, being of oxides which are very brittle, are shattered into a fine dust-like powder while the cores of metal powder are burnished and a strain is produced in the surface of the cores to promote and enhance sintering.

The mixture of relatively large particles of metal, together with or without a fine particulate of oxide materials, may be conditioned, then placed in a die and press-molded, after which the part is ejected from the die and sintered; it may be compacted into a sheet or into a strip and sintered; or it may be compacted in a die, pre-sintered and forged to a near-net shape which requires only a minimum of additional machining.

After the skins are removed from the cores of the particles ferromagnetic particles may be separated by a magnetic separator from contaminating nonferromagnetic particles and dust.

The metallic particles optionally may be delivered to a double screen sifter wherein the first screen removes all particles which exceed a predetermined size. The second screen removes all particles smaller than a second predetermined size. The remaining particles may optionally then be delivered to a blender to produce a powder having a random distribution of particle sizes within the predetermined range.

The resulting particles will have substantially no loose oxides or other impurities, for they will have crumbled into fine grain powder and then have been removed by the magnetic separator and the double screen sifter.

The surfaces of the remaining particles will be metallic and shiny, and sharp spikes and hooks will be blunted whereby the particles may flow easily, for example, into a compacting mill roll gap or into a compacting die.

Further, the highly burnished surfaces contain a substantial amount of energy of deformation in the form of induced stresses caused by the burnishing. The high surface energy of the particle surfaces is conducive to rapid sintering and tougher particle-to-particle bonds. For example, the burnished particles may be sintered into a tough strip at a temperature of 2300° F. in a time of less than two minutes. The toughness, defined as the area under a stress-strain curve, of sintered bars of particles, and the speed of sintering are increased compared to sintered bars of prior art powder.

It is therefore an object of this invention to shatter and remove the oxide-containing and impurity containing skins of metal particles.

It is also an object of this invention to burnish the exposed surfaces of the cores of metal particles.

It is likewise an object of this invention to improve the sintering characteristics of metal particles.

It is a further object of this invention to provide particles suitable for producing low-oxide ferrous mill products and engineering components.

BRIEF DESCRIPTION OF THE DRAWINGS

Other objects will become apparent from the following description, taken together with the accompanying drawings in which.

DETAILED DESCRIPTION OF THE INVENTION

Figure 1:
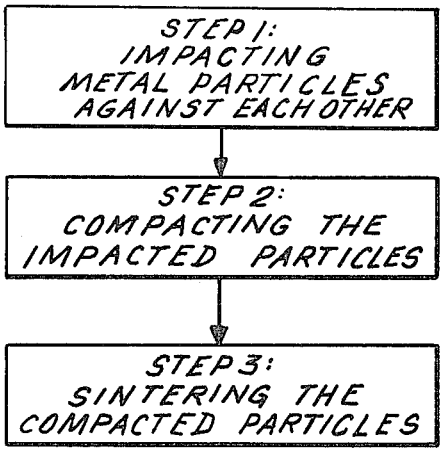
FIG. 1 is a block diagram of a first embodiment of the process of this invention.
Figure 2:
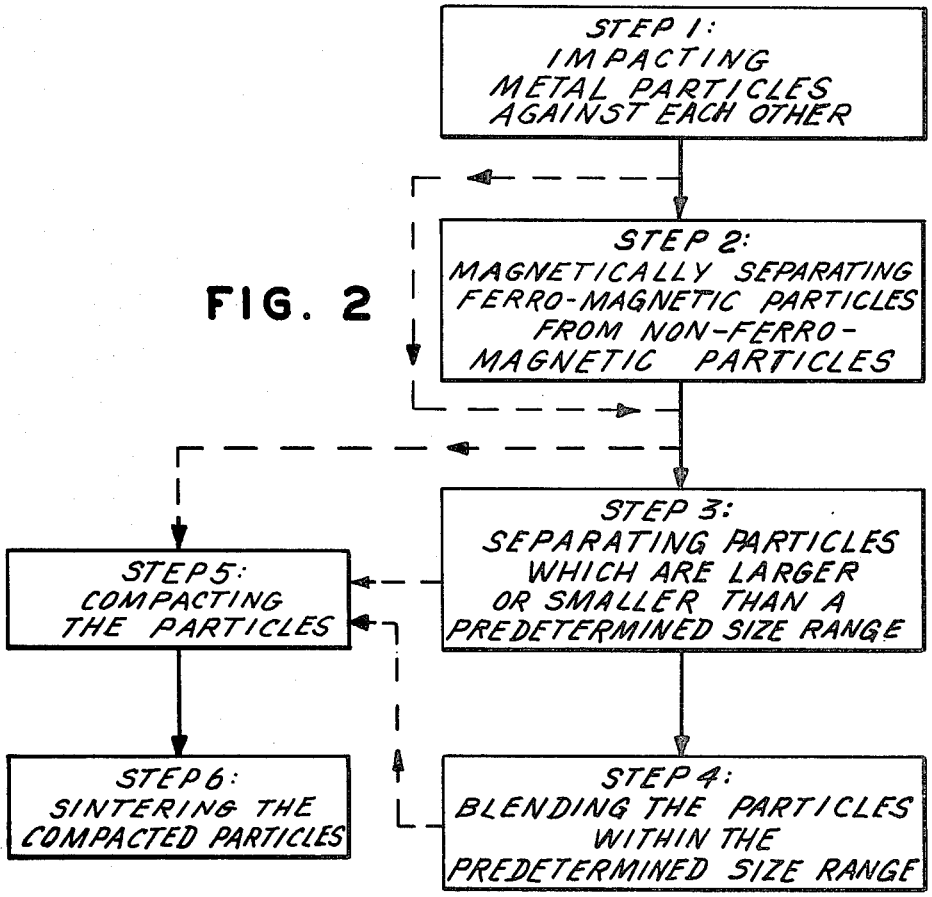
FIG. 2 is a block diagram of a second embodiment of the process of this invention.
Figure 3:
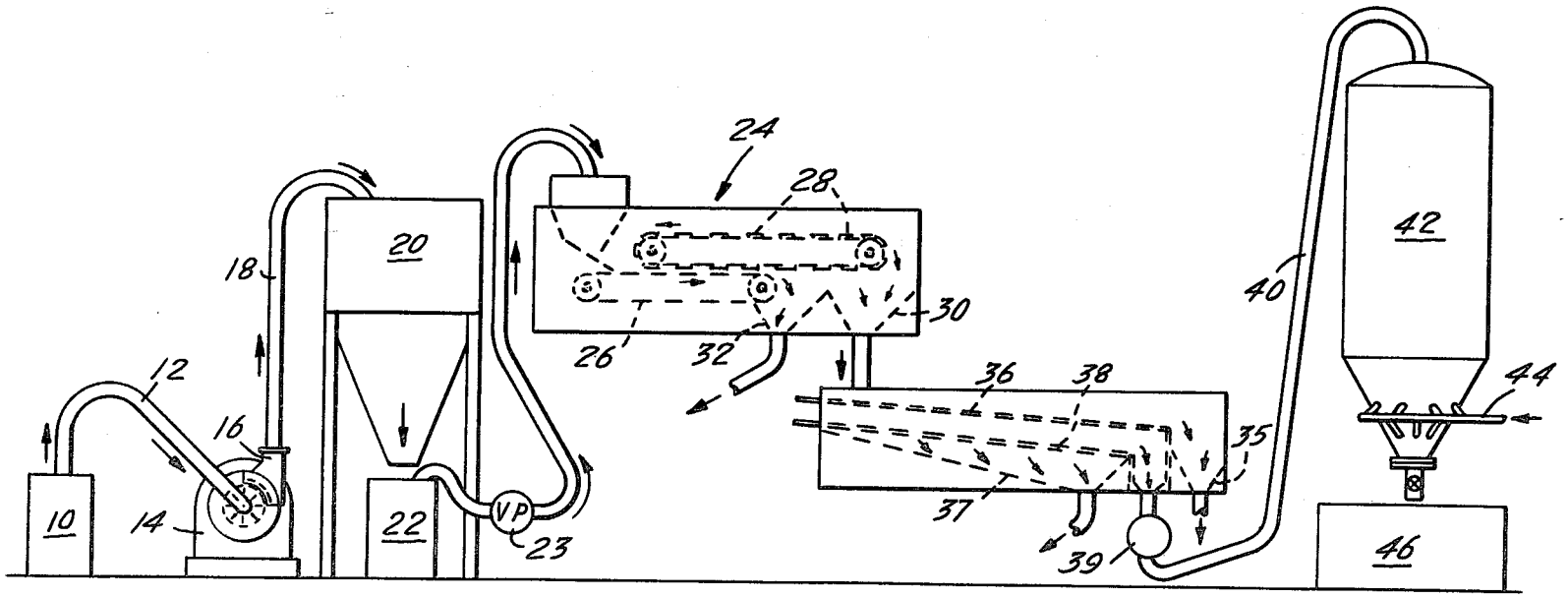
FIG. 3 is a schematic diagram of a typical apparatus used to practice the process of this invention.

The process of this invention described in FIGS. 1 and 2 modifies ferrous particles, and particularly as-water-atomized particles of iron, low carbon steel, and low alloy steel by removing the outer oxide and impurity skin which shatters into a fine powder. The cores of the particles are burnished to remove sharp points and to strain the surface thereof to promote and enhance the speed of sintering and the toughness of the sintered product.

The bright metal burnished steel cores are initially mixed with the finely shattered oxide material which can be separated from the cores if desired. The mixture or the separated burnished cores can then be placed in a die and sintered. The sintering occurs extremely rapidly, and particularly to produce a metal having tough core-to-core bonds with, at most, only finely divided oxide and impurity inclusions due to the finely divided skins. The pores are substantially eliminated during the rapid sintering.

If preferred, the finely divided oxides may be removed, and the bright metal cores remain to produce an even lower oxide metal.

The non-treated particles, stored in a storage bin 10 are delivered through a conduit 12 to an air impact machine 14. The particles are typically delivered into the air impact machine where they collide with each other, occasionally bounce off of the walls of the machine, and occasionally hit the rotor which creates a high velocity highly turbulent whirling gas stream to self impact the particles to crack and shatter the skins of the particles, leaving substantially solid metal cores which then are burnished by continued striking together of the cores. The burnishing removes sharp points allowing the bright metal cores to flow more easily, and if continued it places a strain in the surface of the bright metal cores thereby promoting and enhancing the ability of the cores to sinter.

A typical machine 14 is an air impact pulverizer such as the machine manufactured by the Majac Division of Donaldson Company, Inc. of Tulsa, Okla. The machine has a plurality of radially directed vanes on its rotor. The unprocessed particles are introduced substantially along the axis of the rotor, and the high velocity gas stream causes them to whirl rapidly around the rotor axis. The inertia of the particles causes them to move radially outward until they strike a plurality of bars which are positioned around the periphery of the drum or housing and which are stationary. These bars deflect the particles in a random direction toward the center of the rotor. The specific direction of motion of the particles after striking the outer bars or striking another particle is not precisely known, but it is known that a substantial gas turbulence is produced to increase the probability of one particle striking another particle. One circumferential zone of the machine 14 has an opening and a screen. The openings in the screen are substantially larger than the particles, and the size of the opening determines the amount of average dwell time of the cores of the particles within the air impact machine 14. The shattered oxides and other impurities, however, being very small are drawn off more rapidly and shortly after being shattered. The cores of the particles remain for a time within the air impact machine where continued striking against each other burnishes the cores, removes sharp spikes, and places a strain in the surface of the burnished cores. Each of the burnished cores eventually leaves the air impact machine via the opening 16. After leaving the opening 16, the light weight shattered skins are delivered through a conduit 18 into a filter 20 where the particulates are collected from the gas or air which is pumped out of the air impact machine 14. The burnished cores, being heavier, together with a portion of the shattered finely divided oxides are typically delivered, for example, by gravity into a hopper 22 bypassing the filter 20. When one inspects the burnished core, one finds spherical indentations on the surfaces of the cores rather than flattening of the cores which would be expected if the burnishing occurred through impact against the rotor, the bars, or the sides of the housing. Further, one finds that unexpectedly the rotor, bars and housing are not substantially worn by the particles which leads to the conclusion that the cracking of skins and burnishing of cores occurs by impacting of the particles against each other. It is estimated that 90 to 95% of the burnishing occurs from particle-to-particle impact.

When a low oxide steel is desired, the magnetic separator 24 may be used to further separate the ferromagnetic particles from the nonferromagnetic particles. All the particles in the separator 24 are delivered onto a belt 26. A plurality of electromagnets 28 move with and adjacent to the belt 26. The electromagnets 28 are magnetically cycled so that they first attract magnetic particles from the belt 26 then drop the attracted particles onto the top of the layer of particles on the belt 26. That process is repeated as the mixture proceeds along the belt 26. As it comes to the end of the belt 26, the magnets 28 pick up the ferromagnetic particles and deliver them to the hopper 30. The nonferrogmagnetic materials are mechanically delivered to the hopper 32 and then into a discard bin (not shown).

It has been found that the highly burnished cores with strained surfaces sinter rapidly. For example, typical sintering of particles processed by prior known art may take forty-five minutes at 2050° F. Sintered products made by the process of this invention have equivalent strength and toughness when sintered from one-sixth to one-third the time at 2050° F. For example, burnished cores sintered 15 minutes at 2050° F. produce strength and toughness properties in the sintered metal equal to that obtained by forty-five minutes of sintering of particles produced by prior art.

Three compacted samples of the same lot of as-water-atomized steel particles were prepared. Samples I and II were not treated according to the process of this invention. Sample III was treated according to the invention, and the burnished cores were separated from the finely ground skins. Samples I and III were sintered for five minutes, and sample II was sintered for thirty minutes at 2050° F. Identically shaped and sized samples of the sintered product were tensile tested. Sample I had an ultimate strength of 18,300 psi and an elongation of 4%. Samples II and III had almost identical ultimate strengths of 22,000 and 22,200 psi. Sample III, however, had an elongation of 6% compared to the elongation of 5% for Sample II. Thus, the toughness of Sample III was greater than that of Sample II and over three times greater than Sample I.

Further, if the sintering temperature is increased to 2300° F., compacted burnished core particles produced by the process of this invention and compacted reach a toughness, in two minutes of sintering time, equal to the toughness of the same compacted burnished cores obtained in 15 minutes of sintering at 2050° F. To obtain the same levels in compacts of particles produced by the prior art would require a sintering treatment of about forty-five minutes at 2050° F.

Metallurgical inspection of sintered products reveals that the pores of the rapidly sintered material of this invention are substantially fewer and smaller than the pores in slower sintered materials.

The ferromagnetic burnished particle cores optionally may be delivered to a pair of sieves or wire strainers 36 and 38 which are preferably agitated (by means not shown). The mesh of the sieve 36 is large so that only very large particles are blocked. The remainder of the material goes through the sieve 36 onto the sieve 38 which passes very small particles. The very large particles are removed through hopper 35; the very fine particles are removed through hopper 37. The metallic cores within a predetermined range of sizes may then optionally be pumped by pump 39 and delivered through conduit 40 to the blender 42.

The blender 42 receives particles from the conduit 40, and air introduced through the conduits 44 is directed to cause the particles in the blender 42 to swirl to mix the various desired sizes into a homogenous mixture. The resulting mix is delivered to the hopper 46.

The mix, at any step after removal from the air impact machine, may be further processed by compacting and sintering, then further cold and/or hot rolled to produce a strip of metal having varying degrees of fine oxide inclusions and varying degrees of homogeneity of particle mix.

Thus the process of this invention substantially removes the oxides and impurities on preferably as-water-atomized ferrous metal particles to produce low oxide iron, low carbon steel, and low alloy steel, or optionally such metals with finely ground inclusions.

Just as importantly the invention produces metallurgical particles which sinter very rapidly into tough low pore metal shapes. It particularly produces compacted and sintered as-water-atomized particles for very tough steel products.

Although the invention has been described in detail above, it is not intended that the invention should be limited by that description but only by that description in combination with the description in the appended claims.

We claim:

1. A powder metallurgical process for changing the characteristics of as-water-atomized ferrous metal particles having oxide skins comprising:

(a) impacting said particles against each other in whirlwind of rapidly moving gas at velocities sufficient to crack and shatter the oxide skins of said particles while (b) inducing strain energy on the particle surfaces only without straining the cores of the particles.

2. The invention of claim 1 wherein the impacted particles are compacted and the compacted particles are thereafter sintered.

3. The invention of claim 1 further comprising the step of magnetically separating the ferromagnetic particles from nonferromagnetic particles.

4. The process of claim 1 and further comprising separating and discarding particles which are larger or smaller than a predetermined size range of said particles.

5. The process of claim 4 and further comprising blending said particles which are within said predetermined size range.

* * * * *